US009500171B2

(12) United States Patent
Rickis et al.

(10) Patent No.: US 9,500,171 B2
(45) Date of Patent: Nov. 22, 2016

(54) PRESSURE REGULATING VALVE

(71) Applicants: Aaron Rickis, Feeding Hills, MA (US); David J. Podgorski, Suffield, CT (US)

(72) Inventors: Aaron Rickis, Feeding Hills, MA (US); David J. Podgorski, Suffield, CT (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 1015 days.

(21) Appl. No.: 13/712,479

(22) Filed: Dec. 12, 2012

(65) Prior Publication Data

US 2014/0158227 A1 Jun. 12, 2014

(51) Int. Cl.
*F02M 69/54* (2006.01)
*F02M 63/00* (2006.01)

(52) U.S. Cl.
CPC ..... *F02M 63/005* (2013.01); *F02M 63/004* (2013.01); *Y10T 137/7793* (2015.04)

(58) Field of Classification Search
CPC .... F02M 61/004; F02M 61/005; F02C 7/232
USPC ..... 137/505
See application file for complete search history.

(56) References Cited

U.S. PATENT DOCUMENTS 2,836,198 A * 5/1958 McNeill ..... F16K 39/04 137/625.35
3,910,314 A 10/1975 Nicholson
4,415,209 A * 11/1983 Schopper ..... F16D 65/22 188/349
4,757,973 A * 7/1988 Rizk ..... F02M 59/36 251/210
6,328,056 B1 * 12/2001 Kumar ..... F02C 7/232 137/115.09
6,397,890 B1 * 6/2002 Mickelson ..... F15B 13/0402 137/625.34
7,950,416 B2 * 5/2011 Nakai ..... F16H 61/0251 137/625.65
8,387,659 B2 * 3/2013 Hunnicutt ..... F15B 13/0402 137/625.35
2007/0199601 A1 * 8/2007 Imhof ..... G05D 7/0133 137/625.64

FOREIGN PATENT DOCUMENTS

DE 4231598 C1 1/1994

OTHER PUBLICATIONS

Ni, et al, Compensation Force CFD Analysis of Pressure Regulating Applied in FMU of Engine and System Controls, 2011-01-2641, Copyright 2011 SAE International, 7 Pages.*
GB Search Report for GB Application No. 1321715.3, dated Jul. 24, 2014, pp. 1-6.

* cited by examiner

*Primary Examiner* — Hieu T Vo
*Assistant Examiner* — Arnold Castro
(74) *Attorney, Agent, or Firm* — Cantor Colburn LLP

(57) ABSTRACT

A pressure regulating valve includes a housing having a valve inlet and a valve outlet. A movable piston is located in the housing, and a position of the piston is determined by a selected difference between and inlet pressure and an outlet pressure. The movable piston at least partially defines one or more flow channels between the valve inlet and the valve outlet. When the movable piston is in a fully open position, an axial inlet opening at an inlet end of the one or more flow channels is smaller than an radial depth of the one or more flow channels at the inlet end of the one or more flow channels.

12 Claims, 7 Drawing Sheets

PRESSURE REGULATING VALVE

BACKGROUND OF THE INVENTION

The subject matter disclosed herein generally relates to pressure regulation in fluid flow systems, such as fuel flow systems.

In a fuel system for an engine, for example, an aircraft engine, a pressure regulating valve is utilized to deliver fuel at a selected pressure and mass flow rate to the engine by a controlling pressure drop across a fuel controlling valve. Excess fuel flow is bypassed. A typical pressure regulating valve 100 is shown in FIG. 7. The valve 100 includes a movable piston 102 biased toward a closed position (shown in FIG. 7) by a spring 104 and by pressure P2. Inlet pressure P1 urges the piston into an opened position against the bias of the spring 104. Fluid flow 106 flows in through a valve inlet 108 at P1 and out through valve outlet 110 at PD. A key feature of the piston 102 is neck diameter 112, and neck opening height 114 between piston 102 and cylinder 116. During valve operation, once the piston 102 travels such that an axial opening width 118 equals the neck opening height 114, the valve 100 reaches its saturation point, meaning that additional travel of the piston 102 will not help pass more flow through the valve, and the valve is effectively an orifice that loses the ability to control the pressure drop across the valve. To avoid saturation in valve design, the neck opening height 114 is typically increased, but this results in flow velocity at the valve outlet 110 to be decreased. With lower outlet flow velocity, it is difficult to balance forces in the valve 100 and such conditions also result in valve "droop", pressure setting shift from the set point. Further, the neck opening height 114 must be sized to meet requirements at high flow and low pressure conditions (droop high limit). Thus, operation at high flow and high pressure conditions will increase droop in the valve 100.

BRIEF DESCRIPTION OF THE INVENTION

According to one aspect of the invention, a pressure regulating valve includes a housing having a valve inlet and a valve outlet. A movable piston is located in the housing, and a position of the piston is determined by a selected difference between and inlet pressure and an outlet pressure. The movable piston at least partially defines one or more flow channels between the valve inlet and the valve outlet. When the movable piston is in a fully open position, an axial inlet opening at an inlet end of the one or more flow channels is smaller than an radial depth of the one or more flow channels at the inlet end of the one or more flow channels.

According to another aspect of the invention, a fuel flow system includes a fuel source, a fuel pump, a fuel controlling valve and an engine in fluid communication with the fuel source. A pressure regulating valve is in fluid communication with the fuel source and fuel controlling valve. The fuel controlling valve is in fluid communication with the engine. The pressure regulating valve includes a housing having a valve inlet to receive a flow of fuel from the fuel source at an inlet pressure and a valve outlet to output the bypass flow of fuel not needed by the engine back to the pump inlet at a pump inlet pressure. The pressure regulating valve also controls the pressure across the fuel controlling valve. A movable piston is located in the housing, and a position of the piston is determined by a selected difference between the inlet pressure and the outlet pressure. The movable piston at least partially defines one or more flow channels between the valve inlet and the valve outlet. When the movable piston is in a fully open position, an axial inlet opening at an inlet end of the one or more flow channels is smaller than an radial depth of the one or more flow channels at the inlet end of the one or more flow channels.

According to yet another aspect of the invention, a pressure regulating valve includes a housing having a valve inlet and a valve outlet. A movable piston is located in the housing, and a position of the piston is determined by a selected difference between and inlet pressure and an outlet pressure, the movable piston at least partially defining one or more flow channels between the valve inlet and the valve outlet. At least one bypass passage extends through the piston allowing a portion of flow to bypass the one or more flow channels. At least one bypass passage includes a bypass inlet located axially upstream of the inlet end of the one or more flow channels and a bypass outlet located axially downstream of an outlet end of the one or more flow channels.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
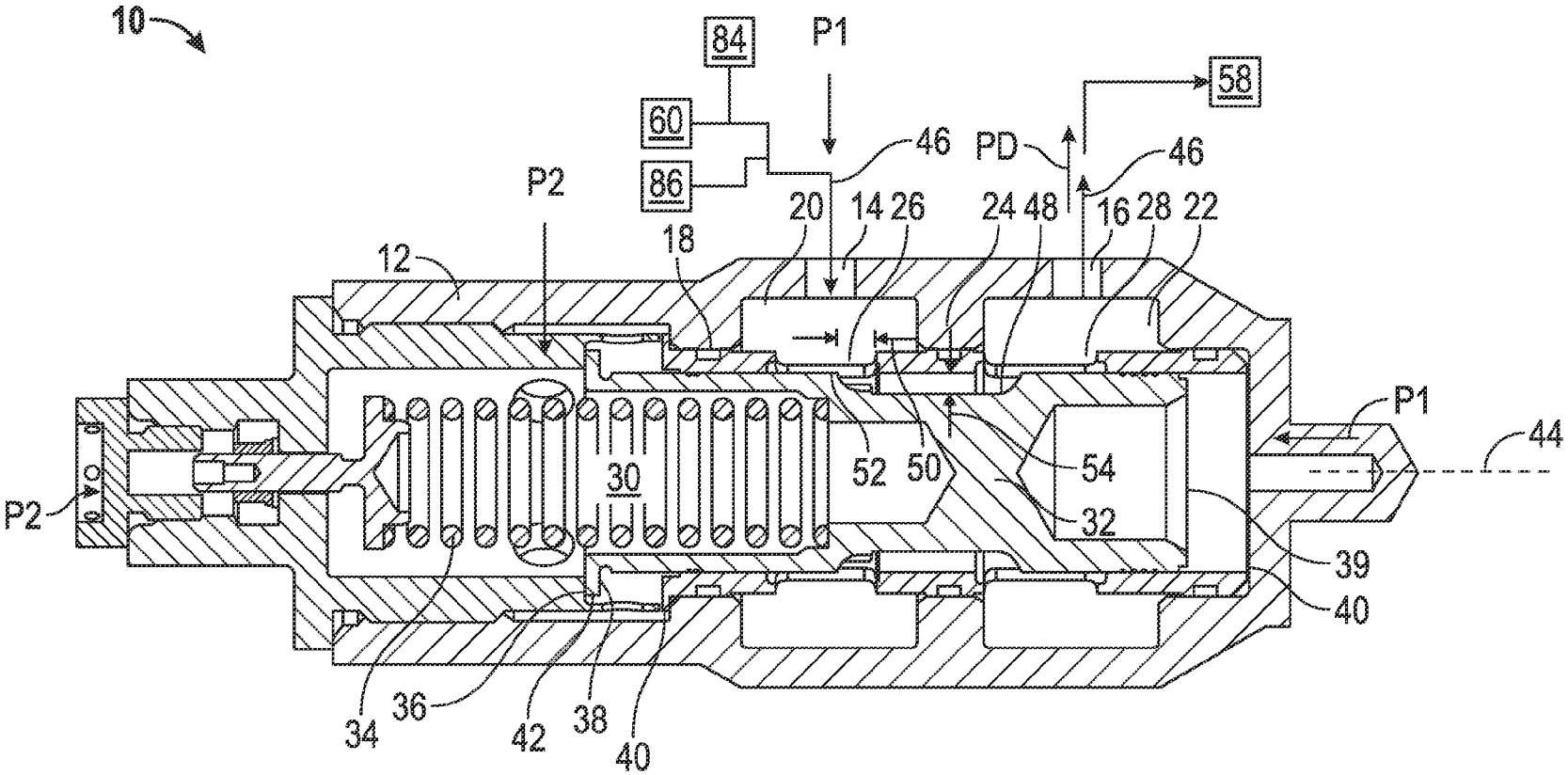
FIG. 1 is a cross-sectional view of an embodiment of a pressure regulating valve.
Figure 2:
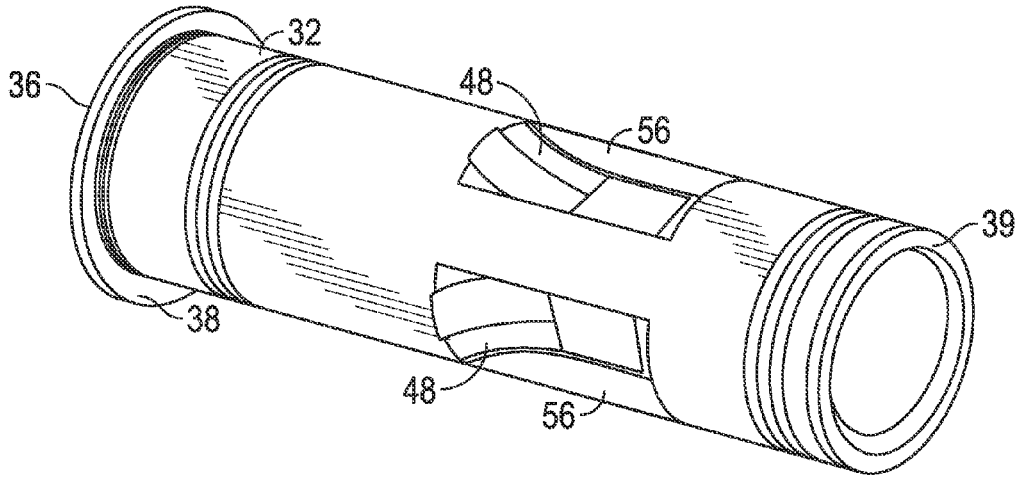
FIG. 2 is a perspective view of an embodiment of a piston for a pressure regulating valve.

Shown in FIG. 1 is an embodiment of a pressure regulating valve 10. The valve 10 includes a valve housing 12 having an inlet opening 14 and an outlet opening 16. A fixed sleeve 18 is located in the housing 12 and, together with the housing 12, defines an inlet plenum 20 and an outlet plenum 22 between the housing 12 and the sleeve 18. In the embodiment shown, the inlet plenum 20 and the outlet plenum 22 are separated by a separator wall 24 formed in the housing 12. The sleeve 18 further includes an inlet metering opening 26 and an outlet metering opening 28 for flow into and out of an interior 48 of the valve 10. A movable valve piston 32 is located in the interior 30 of the valve 10, inboard of the sleeve 18. The piston 32 is biased toward a closed position by a biasing member, for example, a spring 34 located at a first end 36 of the piston 32. When in the closed position, a second end 38 of the piston 32 abuts a closed stop 40. Similarly, when in a fully opened position, the first end 36 abuts an open stop 42. It is to be appreciated that while the stops 40, 42 in the embodiment of FIG. 2 are located along intermediate portions of the piston 32, other stop configurations are contemplated within the present scope, including having stops at opposite ends of the piston 32.

Piston 32 is selectively movable along a valve axis 44 toward the fully opened position (shown in FIG. 1), by pressure P1 (inlet pressure) acting on the second end 39 to overcome the bias of the spring 34. Pressure P1 is counteracted by desired outlet pressure force P2 acting on the first end 36, so that piston 32 is moved to an open position reflective of P1-P2.

Piston 32 is shaped to allow a metered amount of flow 46 between the inlet plenum 20 and outlet plenum 22, when the piston 32 is moved to an at least partially opened position. Specifically, referring to FIG. 2, the piston 32 includes a plurality of axially-extending flow channels 48 around a circumference of the piston 32. The flow channels 48 are located such than when the piston 32 is at the closed position, an axial inlet opening 50 between an upstream channel wall 52 and the inlet metering opening 26 is closed. As the piston 32 is moved toward the fully opened position, as shown in FIG. 1, the axial inlet opening 50 opens and becomes larger, allowing the metered flow 46 into the flow channels 48. A channel depth 54 is configured such that it is larger than the axial inlet opening 50 length when the piston 32 is at the fully opened position, thus preventing the valve 10 from saturating, even with a large piston 32 stroke. Further, sidewalls 56 of the flow channels 48 constrain the flow 46 circumferentially, preventing the flow 46 from diffusing around the piston 32, as with the continuous annulus of the prior art piston 32. Saturation of the valve 10 causes the valve 10 to stop regulating/performing, as saturation effectively turns the valve into a fixed orifice.

Figure 3:
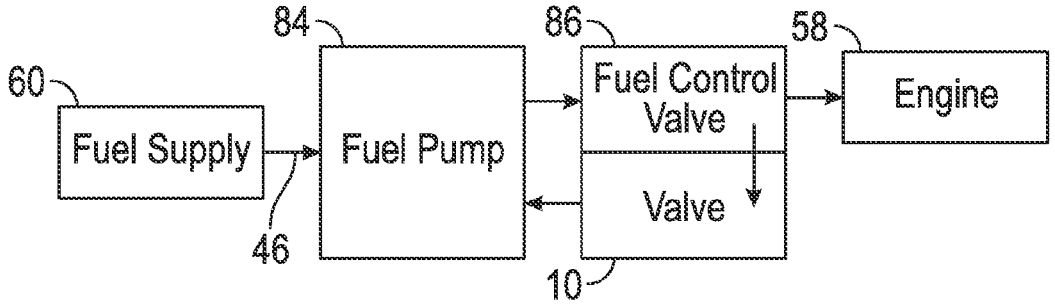
FIG. 3 is a schematic of an embodiment of a fuel system.

In operation, and with reference to FIGS. 1 and 3, the fluid 46, for example, fuel for an engine 58 such as an aircraft gas turbine engine, is pumped from a fuel source 60 via a fuel pump 84 and through a fuel control valve 86 to the valve 10 and into the inlet opening 14 at the first pressure, P1. The selected pressure for the fluid 46 to be received at the engine 58 is metered outlet pressure, P2. The difference between P1 and outlet pressure P2 urges the piston 32 to at least a partially opened position. The fluid 46 flows into the inlet plenum 20 and through the flow channels 48 into the outlet plenum 22. As it flows through the flow channels 48 and into the outlet plenum 22, the pressure of the fluid 46 is reduced from P1 to valve discharge pressure, PD. Fluid at discharge pressure PD is output toward the engine 58, while any excess fluid 46 is routed back to the fuel pump 84 at discharge pressure PD.

Figure 4:
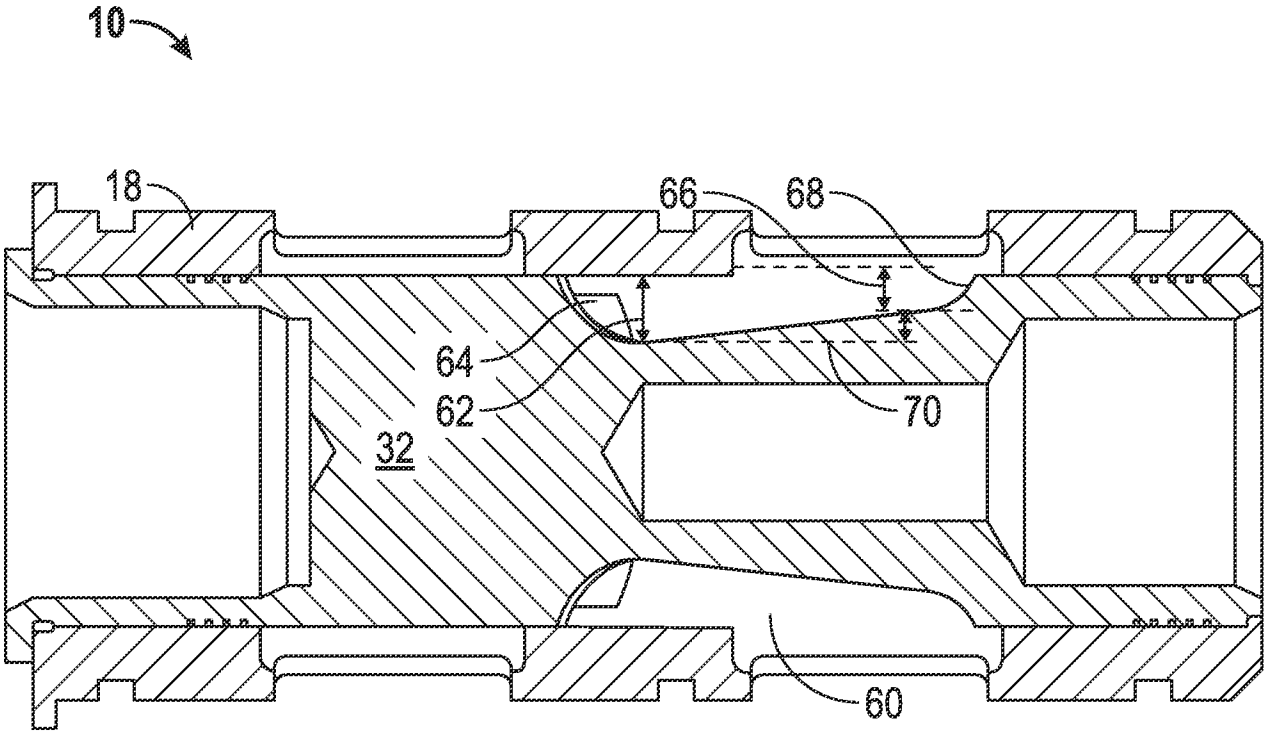
FIG. 4 is a cross-sectional view of another embodiment of a pressure regulating valve.
Figure 5:
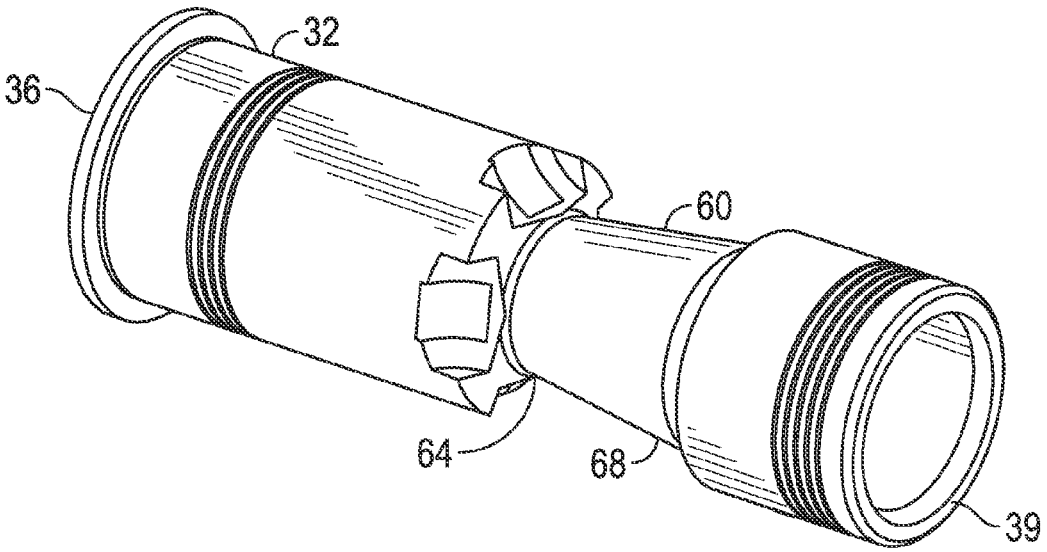
FIG. 5 is a perspective view of another embodiment of a piston for a pressure regulating valve.

In another embodiment, illustrated in FIGS. 4 and 5, The piston 32 includes a conically-shaped flow annulus 60, which is continuous around a circumference of the piston 32. The conically-shaped flow annulus 60 is arranged such that a first depth 62 at an inlet end 64 of the conically shaped flow annulus 60 is greater than a second depth 66 at an outlet end 68 of the conically-shaped flow annulus 60. The first depth 62 is sized to be greater than the axial inlet opening 50 when the piston 32 is in the full open position to prevent saturation of the valve 10. The second depth 66 is sized to meet maximum droop requirements at high flow and low pressure conditions. In some embodiments, a slope angle 70 of the conically-shaped flow annulus 60 is between about 5 and 30 degrees from the first depth 62 to the second depth 66. The conically-shaped flow annulus 60 allows the fluid 46 entering the valve 10 to diffuse at the inlet end 64 to reduce pressure and allow for a larger piston 32 stroke without valve saturation, while accelerating the fluid 46 to the outlet end 68 to maintain flow momentum.

Figure 6:
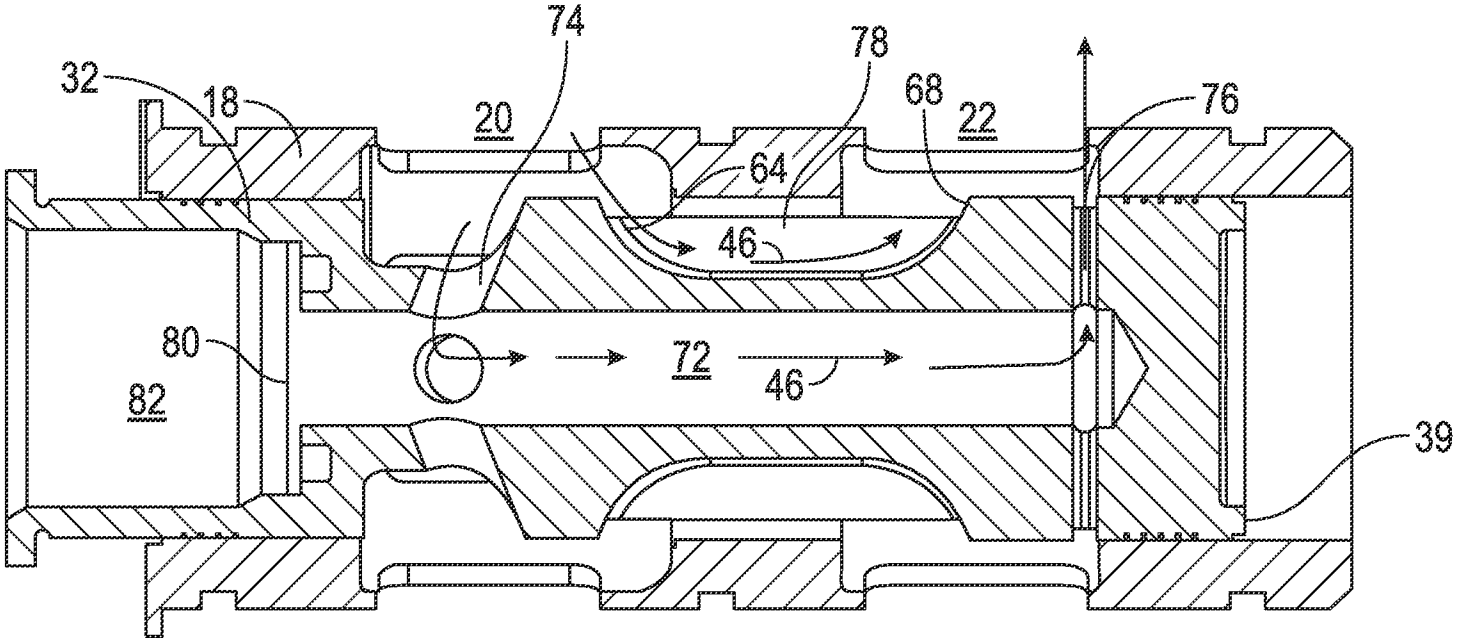
FIG. 6 is a cross-sectional view of yet another embodiment of a pressure regulating valve.
Figure 7:
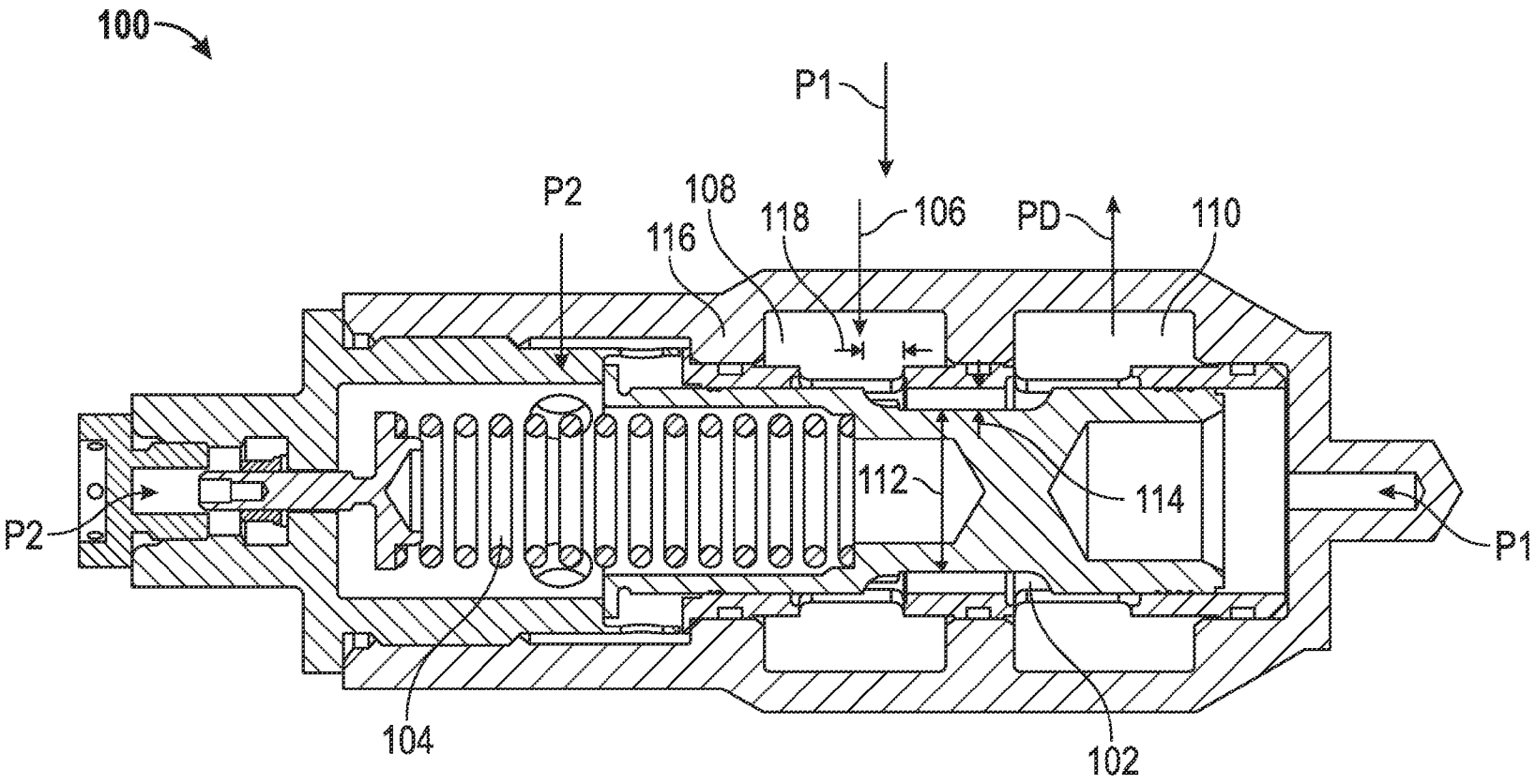
FIG. 7 (Prior Art)
FIG. 7 is a schematic view of a typical pressure regulating valve.

In some embodiments, as in FIG. 6, the piston 32 includes a bypass passage 72 with a bypass inlet 74 located upstream of the inlet end 64 and a bypass outlet 76 located downstream of the outlet end 68. The bypass passage 72 extends axially through the piston 32 and is configured to allow a portion of the fluid 46 to bypass a primary flow passage 78 of the piston 32. The primary flow passage 78 directs fluid 46 between the inlet plenum 20 and the outlet plenum 22 of the valve 10. When the piston 32 is moved to the fully opened position, the bypass outlet 76 is unblocked by sleeve 18 thereby allowing the fluid 46 to flow through the bypass passage 72. Allowing a portion of the fluid 46 through the bypass passage 72 increasing maximum flow rate of the valve 10 at the fully opened position. This increases maximum flow through the valve 10 while not increasing the valve 10 size and still meeting other performance requirements.

In some embodiments, the bypass passage 72 is sized such that between about 20% and 30% of the total fluid flow through the valve 10 is through the bypass passage 72, while the remaining 70% to 80% is through the primary flow passage 78. As shown in FIG. 6 the bypass inlet 74 is angled in a direction to counter momentum at the bypass outlet. It is to be appreciated that while FIG. 5 shows the bypass oulet 74 angled toward piston 32 end 38, other stop configurations are contemplated within the present scope, including having the bypass oulet 74 angled toward piston 32 end 39. Further, in some embodiments, a seal disc 80 is disposed in the piston 32 to prevent flow through an upstream end 82 of the piston 32.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while the various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A pressure regulating valve comprising:

a housing having a valve inlet and a valve outlet; and a movable piston disposed in the housing, a position of the piston determined by a selected difference between an inlet pressure and an outlet pressure, the movable piston at least partially defining one or more flow channels between the valve inlet and the valve outlet;

wherein when the movable piston is in a fully open position, an axial inlet opening at an inlet end of the one or more flow channels is smaller than an radial depth of the one or more flow channels at the inlet end of the one or more flow channels;

wherein the movable piston at least partially defines a single axially-tapered flow annulus extending around a circumference of the movable piston, the axially-tapered flow annulus having a first depth at the inlet end greater than a second depth at an outlet end of the flow channel wherein the movable piston at least partially defines a single axially-tapered flow annulus extending around a circumference of the movable piston, the axially-tapered flow annulus having a first depth at the inlet end greater than a second depth at an outlet end of the flow channel.

2. The valve of claim 1, wherein the movable piston at least partially defines a plurality of axially-extending flow channels arranged around a perimeter of the piston, each flow channel having a depth greater than the axial inlet opening.

3. The valve of claim 2, wherein the piston includes a plurality of flow channel sidewalls to prevent circumferential diffusion of flow through the plurality of flow channels.

4. The valve of claim 1, wherein a taper angle of the axially-tapered flow annulus is between about 5 degrees and about 30 degrees.

5. The valve of claim 1, wherein the second depth is sized to meet maximum droop requirements at high flow and high pressure conditions.

6. The valve of claim 1, wherein the piston includes a substantially conically-shaped portion to define the tapered flow annulus.

7. A pressure regulating valve comprising:

a housing having a valve inlet and a valve outlet; and a movable piston disposed in the housing, a position of the piston determined by a selected difference between an inlet pressure and an outlet pressure, the movable piston at least partially defining one or more flow channels between the valve inlet and the valve outlet;

wherein when the movable piston is in a fully open position, an axial inlet opening at an inlet end of the one or more flow channels is smaller than an radial depth of the one or more flow channels at the inlet end of the one or more flow channels;

wherein the piston further comprises at least one bypass passage extending through the piston allowing a portion of flow to bypass the one or more flow features, the at least one bypass passage including:

a bypass inlet disposed axially upstream of the inlet end of the one or more flow features; and a bypass outlet disposed axially downstream of an outlet end of the one or more flow features.

8. The valve of claim 7, wherein the bypass passage is closed when the piston is not disposed at a fully opened position.

9. The valve of claim 7, wherein the bypass passage is sized to meet maximum droop requirements at high flow and high pressure conditions.

10. A fuel flow system comprising:

a fuel source;

an engine in fluid communication with the fuel source;

a fuel pump to urge a flow of fuel from the fuel source toward the engine;

a fuel control valve to regulate the flow of fuel; and a pressure regulating valve in fluid communication with the fuel source and the fuel control valve including:

a housing having a valve inlet to receive the flow of fuel from the fuel source at an inlet pressure and a valve outlet to output the flow of fuel to the engine at a discharge pressure; and a movable piston disposed in the housing, a position of the piston determined by a selected difference between the inlet pressure and an outlet pressure, the movable piston at least partially defining one or more flow channels between the valve inlet and the valve outlet;

wherein when the movable piston is in a fully open position, an axial inlet opening at an inlet end of the one or more flow channels is smaller than an radial depth of the one or more flow channels at the inlet end of the one or more flow channels;

wherein the piston further comprises at least one bypass passage extending through the piston allowing a portion of flow to bypass the one or more flow features, the at least one bypass passage including:

a bypass inlet disposed axially upstream of the inlet end of the one or more flow features; and a bypass outlet disposed axially downstream of an outlet end of the one or more flow features.

11. The fuel flow system of claim 10, wherein the bypass passage is closed when the piston is not disposed at a fully opened position.

12. The fuel flow system of claim 11, wherein the bypass passage is sized to meet maximum droop requirements at high flow and high pressure conditions.

* * * * *